US007602348B2

(12) United States Patent
Goldberg

(10) Patent No.: US 7,602,348 B2
(45) Date of Patent: Oct. 13, 2009

(54) THREE-DIMENSIONAL ANTENNA FABRICATION FROM A TWO-DIMENSIONAL STRUCTURE

(75) Inventor: Steven J. Goldberg, Downingtown, PA (US)

(73) Assignee: InterDigital Technology Corporation, Wilmington, DE (US)

( * ) Notice: Subject to any disclaimer, the term of this patent is extended or adjusted under 35 U.S.C. 154(b) by 556 days.

(21) Appl. No.: 11/344,283

(22) Filed: Jan. 31, 2006

(65) Prior Publication Data

US 2006/0187124 A1 Aug. 24, 2006

Related U.S. Application Data

(60) Provisional application No. 60/651,608, filed on Feb. 10, 2005.

(51) Int. Cl.
*H01Q 1/08* (2006.01)
*H01Q 1/38* (2006.01)

(52) U.S. Cl. ..... 343/881; 343/846

(58) Field of Classification Search ..... 343/878, 343/880, 881, 915, 846
See application file for complete search history.

(56) References Cited

U.S. PATENT DOCUMENTS 7,126,553 B1 * 10/2006 Fink et al. ..... 343/767

* cited by examiner

*Primary Examiner*—Michael C Wimer
(74) *Attorney, Agent, or Firm*—Allen, Dyer, Doppelt, Milbrath & Gilchrist, P.A.

(57) ABSTRACT

A method for making an antenna array includes dividing a flexible dielectric substrate into a plurality of folding sections, with each folding section being integrally connected to an adjacent folding section along a shared boundary therebetween. The folding sections are co-planar with one another when unfolded and include spaced apart antenna sections, spaced apart ground plane sections and connecting sections therebetween. An antenna element is formed on each antenna section. The antenna elements are coplanar with the antenna sections, the ground plane sections and the connecting sections. The folding sections of the flexible dielectric substrate are folded along the shared boundaries so that the antenna sections extend in a different plane with respect to the ground plane sections.

39 Claims, 5 Drawing Sheets

170(11)
164
182
160(12)
160(11)
170(10)
174
165
184
162
160(10)
163
154
180
170(9)
160(9)
170(8
160(8)
170(7)
160(7)
170(6)
152
160(6)
170(5)
160(5)
170(4)
160(4)
170(3)
160(3)
170(2)
160(2)
170(1)
160(1)
140
124
167

THREE-DIMENSIONAL ANTENNA FABRICATION FROM A TWO-DIMENSIONAL STRUCTURE

RELATED APPLICATION

This application claims the benefit of U.S. Provisional Application Ser. No. 60/651,608 filed Feb. 10, 2005, the entire contents of which are incorporated herein by reference.

FIELD OF THE INVENTION

The present invention relates to the field of antennas, and more particularly, to a method for making a three-dimensional antenna array using two-dimensional structures.

BACKGROUND OF THE INVENTION

Antenna arrays for advanced applications are often constructed in a three-dimensional configuration. Example antenna arrays include beam forming antennas having three or more antenna elements and MIMO antenna arrays. An example three-dimensional antenna array 50 is illustrated in FIG. 1. The antenna array 50 includes an active center antenna element 52, and three passive antenna elements 54 extending outward from a dielectric substrate 56. The passive antenna elements 54 include upper and lower conductive segments 54(1) and 54(2).

The cost to individually produce the active and passive antenna elements 52 and 54, and to assemble the antenna array 50 for small devices is significant when compared to the overall cost of the devices receiving such an antenna array. Moreover, it is also time consuming to assemble three-dimensional antenna arrays.

SUMMARY OF THE INVENTION

In view of the foregoing background, it is therefore an object of the present invention to provide a relatively fast and inexpensive way to fabricate and assemble a three-dimensional antenna array.

This and other objects, features, and advantages in accordance with the present invention are provided by a method for making an antenna array comprising dividing a flexible dielectric substrate into a plurality of folding sections, with each folding section along a shared boundary therebetween. The folding sections are co-planar with one another when unfolded and include spaced apart antenna sections, spaced apart ground plane sections and connecting sections therebetween.

The method further comprises forming at least one antenna element on each antenna section. When unfolded, the antenna elements are coplanar with the antenna sections, the ground plane sections and the connecting sections. The folding sections are folded along the shared boundaries so that the antenna sections extend in a different plane with respect to the ground plane sections. The antenna sections may be orthogonal to the ground plane sections after the folding.

The three-dimensional antenna array is formed in a relatively fast and inexpensive way since the array is initially formed as a two-dimensional structure. After the two-dimensional structure is formed, it is then folded into its final three-dimensional relative positions, and secured in that form.

The method may further comprise forming, before the folding, a ground plane on the spaced apart ground plane sections. The spaced apart ground planes may then be electrically connected after the folding. Alternatively, at least one conductive via may be through at least one of the antenna sections before the folding, so that after the folding the spaced apart ground planes are electrically connected through the at least one conductive via. In yet another embodiment, the ground plane is attached to the ground plane sections after the flexible dielectric substrate has been folded.

The method may further comprise providing at least one electrical component on at least one antenna section before the folding, and forming at least one antenna section before the folding, and forming at least one first conductive path on the antenna section for electrically connecting the at least one electrical component to the at least one antenna element thereon before the folding. At least one second conductive path may also be formed on the antenna section with the electrical component thereon and on an adjacent folding section, with the at least one second conductive path extending through the shared boundary therebetween.

In one embodiment, N antenna elements are formed on the spaced apart antenna sections, with the N antenna elements comprising N active antenna elements so that the antenna array forms a phased array.

In another embodiment, N antenna elements are formed on the spaced apart antenna sections, with the N antenna elements comprising at least one active antenna elements and up to N−1 passive antenna elements for forming a switched beam antenna.

Another aspect of the invention is directed to an antenna array formed as a result of the above described methods.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
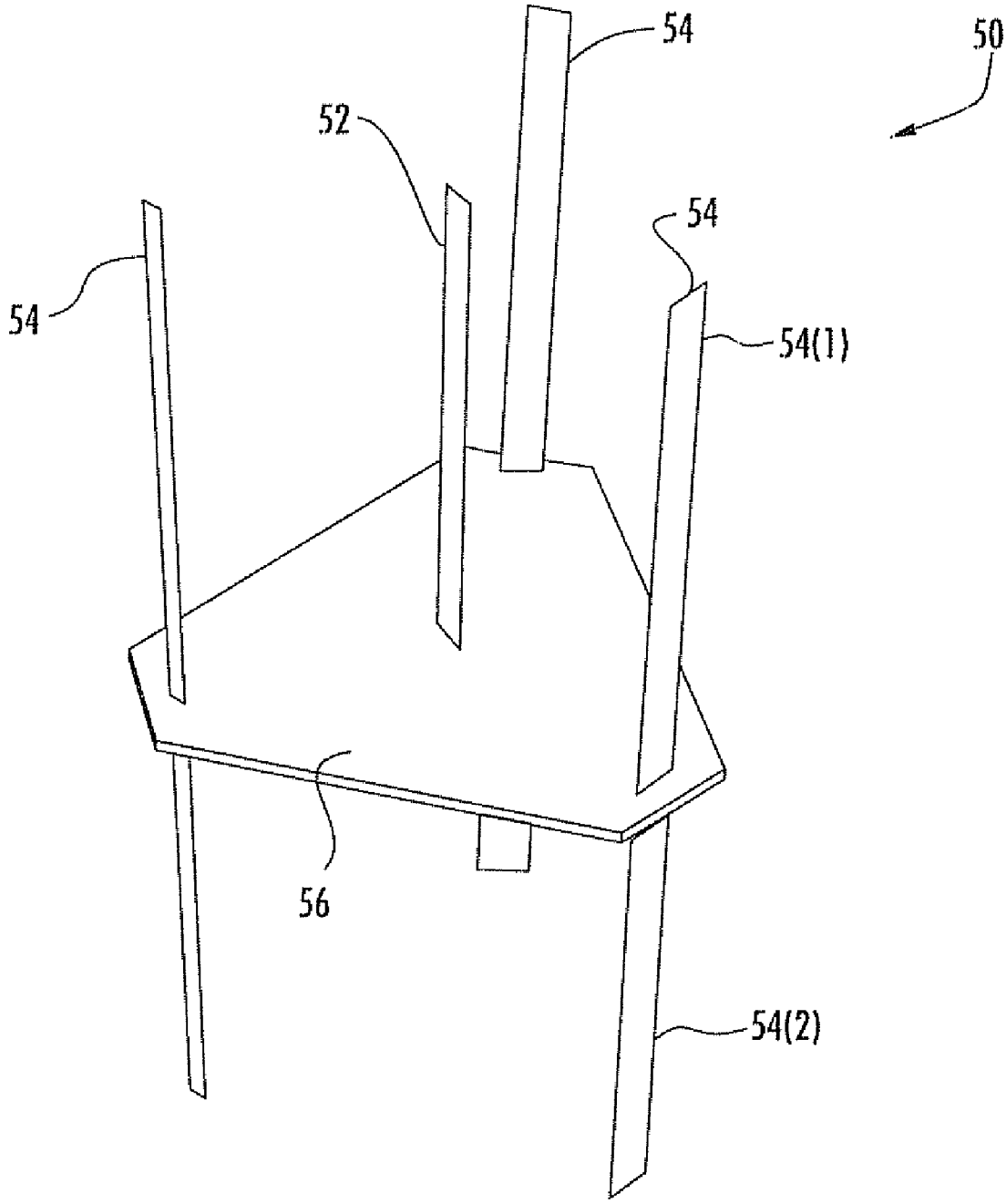
FIG. 1 (PRIOR ART)
FIG. 1 is a perspective view of a three-dimensional antenna array formed in accordance with the prior art.

In accordance with the present invention, the parts for a three-dimensional antenna array are initially formed as a two-dimensional structure. The two-dimensional structure is then folded into its final three-dimensional relative positions, and secured in that form. For purposes of illustrating the present invention, the antenna array 50 shown in FIG. 1 will initially be formed as a two-dimensional structure and then folded into its three-dimensional structure.

Figure 2:
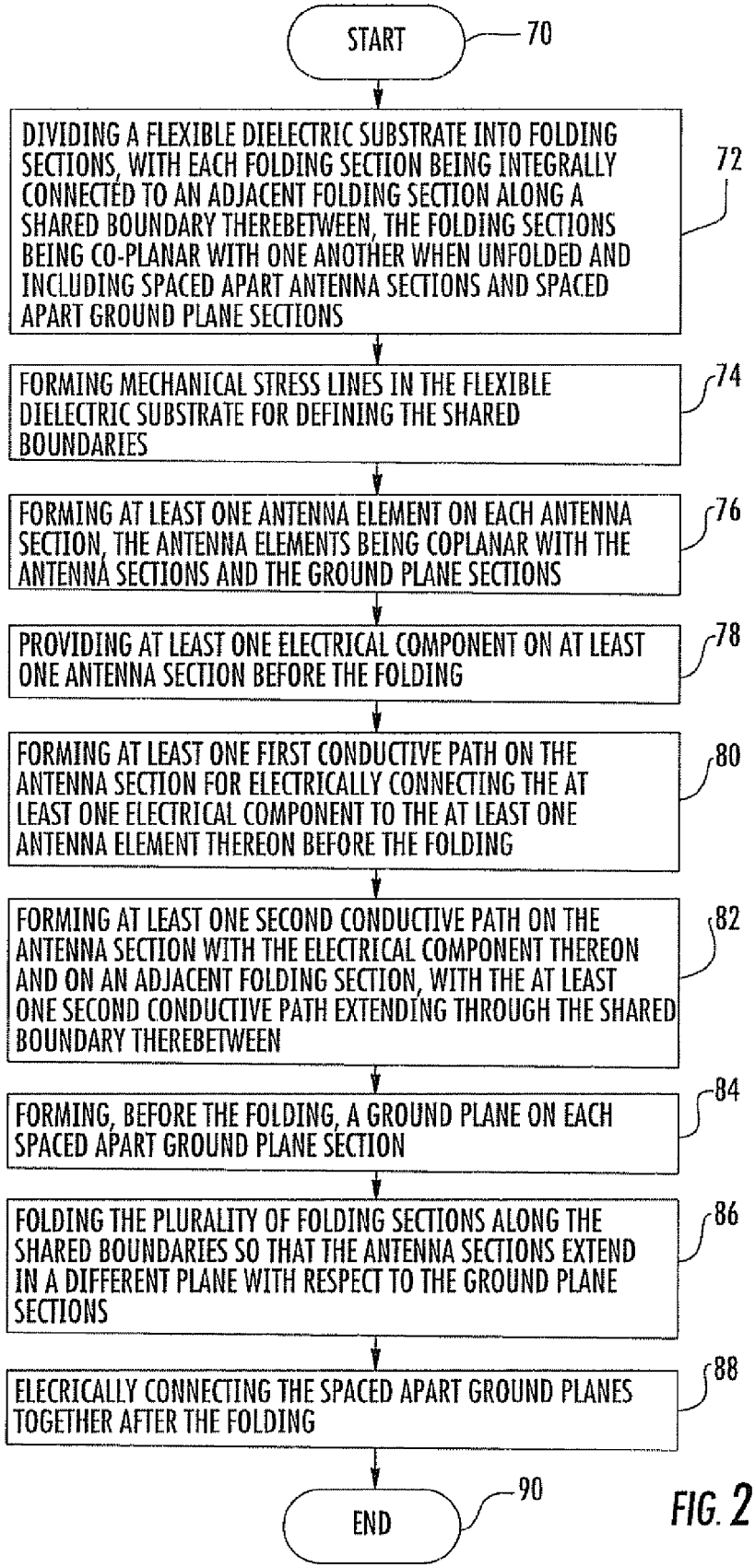
FIG. 2 is a flow chart for making a three-dimensional antenna array from two-dimensional structures in accordance with the present invention.

This particular antenna array 50 is only an example implementation. Antenna arrays having different numbers of antenna elements and spatial orientations can be constructed by the same techniques disclosed below. A flow chart for making the illustrated antenna array 150 in accordance with the invention is provided in FIG. 2, and will be referenced below.

Figures 3, 4:
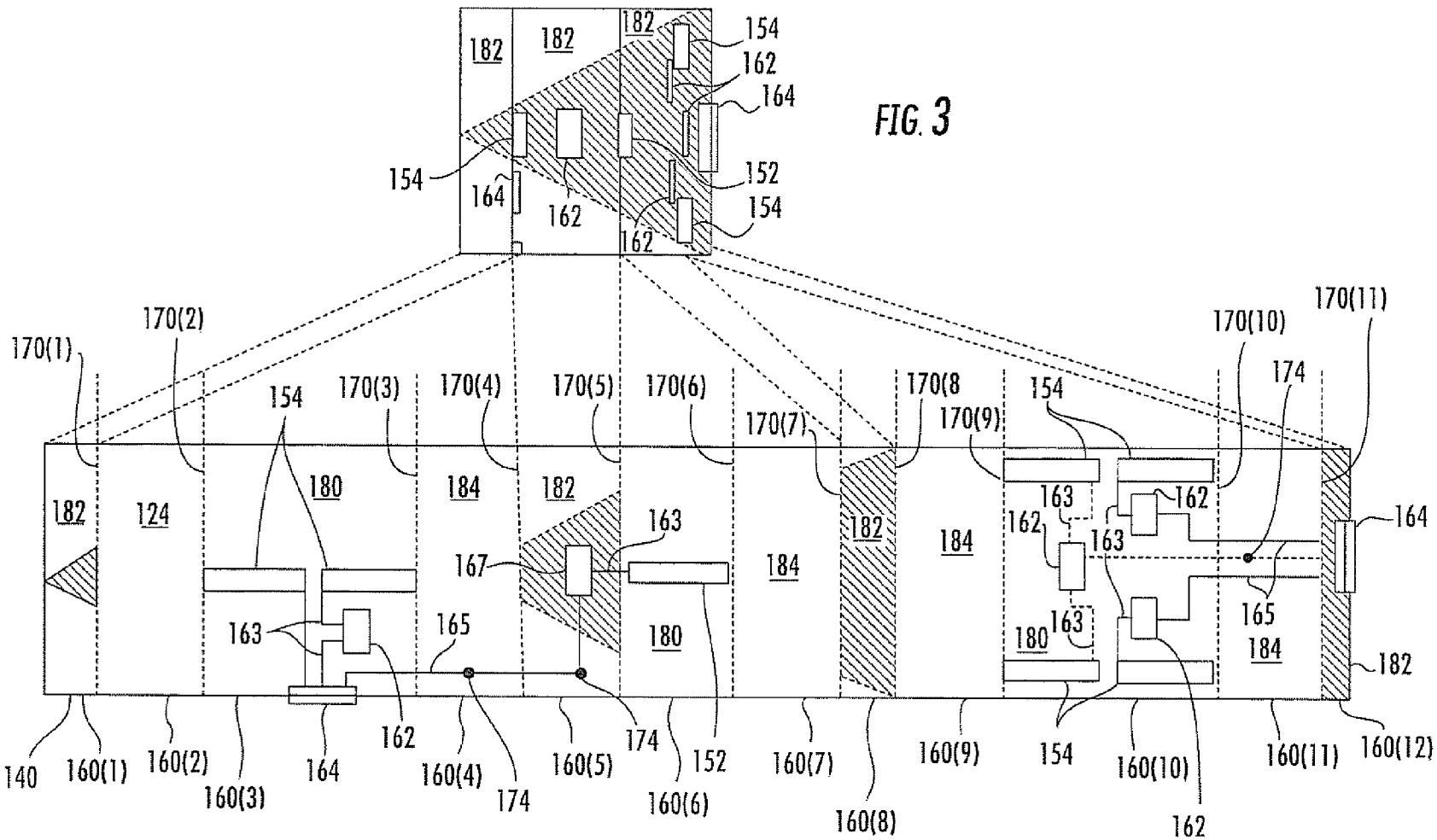
FIG. 3 is a top view of the three-dimensional antenna array fully folded in accordance with the present invention.
FIG. 4 is a top view of the three-dimensional antenna array shown in FIG. 3 before folding, with dashed lines extending between the two figures to indicate the same fold sections.

A top view of the three-dimensional antenna array 150 fully folded is illustrated in FIG. 3, and a top view of the same antenna array before folding is illustrated in FIG. 4. The dashed lines extending between the two figures indicate the same folding sections. Electrical components 162, 167 and connectors 164 typically coupled to the antenna elements 152, 154 are also shown.

The method for making such an antenna array 150 comprises, from the start (Block 70), dividing a flexible dielectric substrate 140 into a plurality of folding sections 160(1)-160(12) at Block 72. The folding sections will be generally referred to by reference 160. Each folding section 160 is integrally connected to an adjacent folding section along a shared boundary 170(1)-170(11) therebetween while being coplanar with one another. The shared boundaries will be generally referred to by reference 170. The folding sections 160 include spaced apart antenna sections 180, spaced apart ground plane sections 182, and connecting sections 184 therebetween. Mechanical stress lines are formed in the flexible dielectric substrate at Block 74 for defining the shared boundaries 170.

The method further comprises at Block 76 forming at least one antenna element 152, 154 on each antenna section 180. The antenna elements 152, 154 are coplanar with the antenna sections 180, the ground plane sections 182, and the connecting sections 184 when the flexible dielectric substrate 140 is unfolded. Electronic ink may be used to lay down the antenna elements 152, 154 in two-dimensions on the flexible dielectric substrate 140. The use of electronic ink to create two-dimensional antenna elements is well known to those skilled in the art.

The flexible dielectric substrate 140 may comprise Mylar, for example. In addition to the dielectric substrate 140 comprising a flexible material, a stiff but scoreable material may also be used. Firm or rigid plastic may be used to sandwich the flexible material. Alternately, the flexible material could reside on the outside surface of the stiff material.

Figure 5:
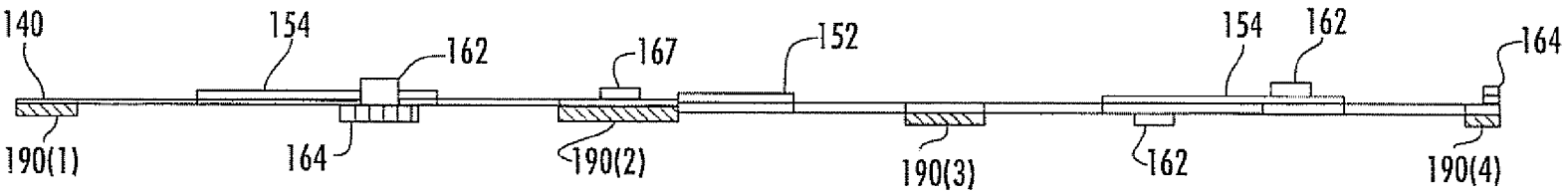
FIG. 5 is a side view of the unfolded three-dimensional antenna array shown in FIG. 4.

A side view of the two-dimensional antenna array structure before being folded is provided in FIG. 5. The antenna elements 152, 154 are on an upper surface of the dielectric substrate 140. A ground plane 190(1)-190(4) is on a lower side of the dielectric substrate 140. The ground plane 190(1)-190(4) has a shape corresponding to the dashed lines on the ground plane sections 182 in FIGS. 3 and 4, with the resulting shape after the folding being a triangle.

The method further comprises providing at least one electrical component 162 on at least one antenna section 180 (Block 78), and forming at least one first conductive path 163 on the antenna section for electrically connecting the at least one electrical component to the at least one antenna element 154 thereon (Block 80).

One or more second conductive paths 165 may be formed on the antenna section 180 with the electrical component 162 thereon at Block 82, and on an adjacent folding section (such as 160(4), for example). The second conductive path extends through the shared boundary therebetween (such as 170(3), for example).

The electrical components 162, 167 may be formed on the flexible dielectric substrate 140, or if discrete components are used, mounted to an upper surface of the dielectric substrate. Alternatively, the electrical components 162 may also be positioned on a lower surface of the dielectric substrate 140, as with folding section 160(10). Accordingly, the conductive paths 163, 165 are formed on either the upper or lower surfaces of the dielectric substrate 140. Conductive vias 174 are used to connect the conductive paths 163, 165 between the two sides of the dielectric substrate 140.

Electrical continuity between various parts is of high importance in the finished product. A ground plane 190(1)-190(4) is attached to each of the separated ground plane areas 182 at Block 84 before the flexible dielectric substrate 140 is folded. The folding sections 160(1)-160(12) are folded along the shared boundaries 170(1)-170(11) so that the antenna sections 180 extend in a different plane with respect to the ground plane sections 182 at Block 86.

Figure 6:
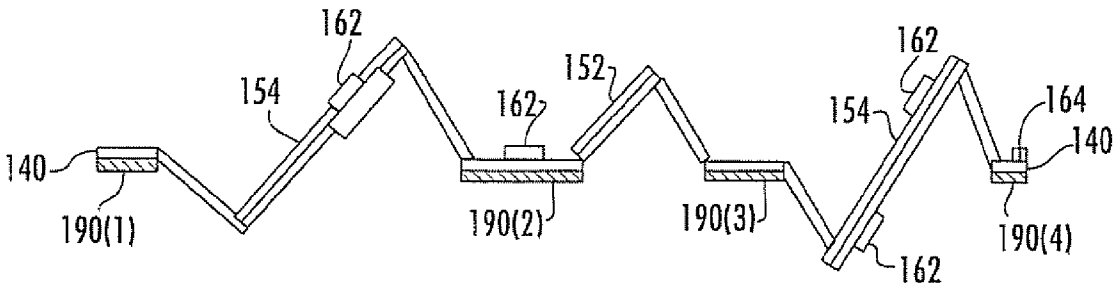
FIG. 6 is a side view of the three-dimensional antenna array shown in FIG. 5 partially folded.
Figure 7:
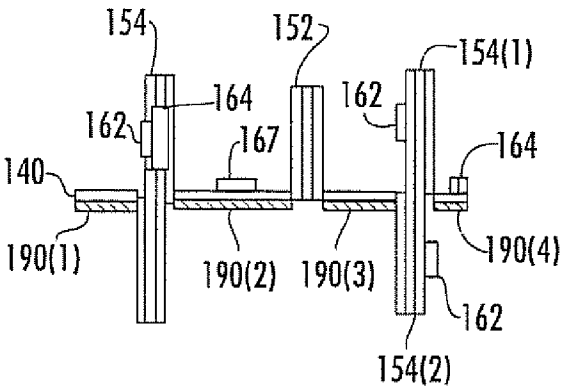
FIG. 7 is a side view of the antenna array shown in FIG. 6 fully folded.

A side view of the three-dimensional antenna array 150 partially folded is provided in FIG. 6, and a side view of the antenna array fully folded is provided in FIG. 7. The illustrated antenna sections 180 are orthogonal to the ground plane sections 182 after the folding, although this is not required.

In one embodiment, the separated ground planes 190(1)-190(4) are all electrically connected after the folding to form one contiguous surface at Block 88. Consequently, the construction of the example antenna array would therefore be better served if the ground plane 190 (triangular shaped) were printed on the reverse side of the dielectric substrate 140.

There are a number of techniques that may be used to electrically connect the surfaces: 1) solder bead along the lines of contact, and 2) the epoxy used to put rigidity in the antenna array structure can be conductive where appropriate.

Figure 8:
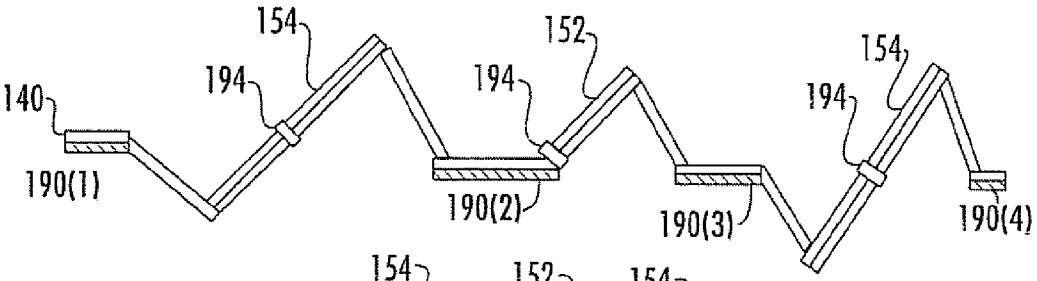
FIG. 8 is the antenna array shown in FIG. 6 with conductive vias extending through certain fold sections.
Figure 9:
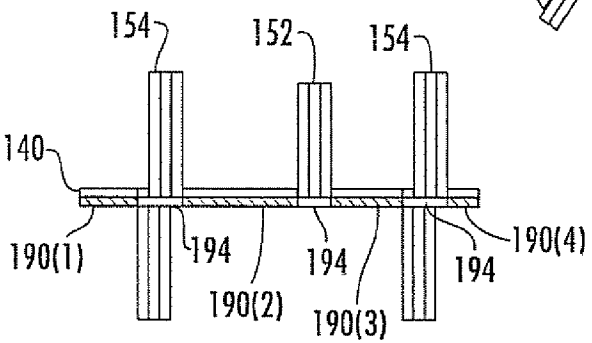
FIG. 9 is the antenna array shown in FIG. 7 with conductive vias providing coupling between the ground plane sections.

The ground plane portions 190(1), 190(4) at either end of the flexible dielectric substrate 140 could be connected to the central ground plane portions 190(2), 190(3) using conductive structures 194 passing through the appropriate folding sections, as shown by the conductive vias 194 in FIGS. 8 and 9.

Figure 10:
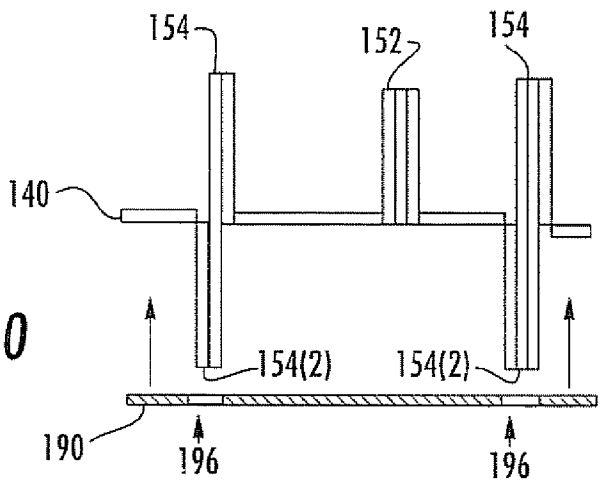
FIG. 10 is a side view of the antenna array fully folded and the ground plane separated therefrom, in accordance with the present invention.
Figure 11:
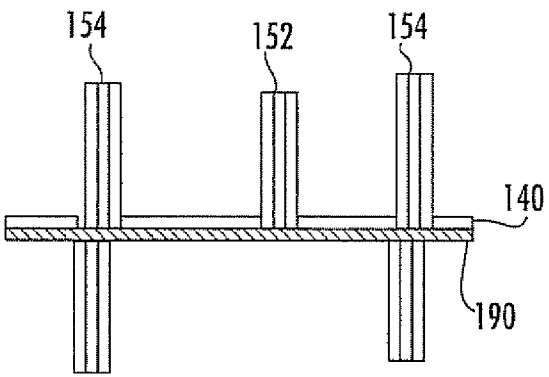
FIG. 11 is the antenna array shown in FIG. 10 with the ground plane attached thereto.

An alternative approach would be to make the ground plane 190 on another piece of material, as shown in FIG. 10, cut out holes 196 for the lower conducting antenna elements 154(2) protruding below the ground plane axis, and secure the structure to the folded version of the antenna array. This may be the same material functioning as the "rigid mounting surface" disclosed above as an option to provide rigidity to the overall antenna array structure. The method ends at Block 90.

In one embodiment, N antenna elements are formed on the spaced apart antenna sections 182, with the N antenna elements comprising N active antenna elements so that the antenna array forms a phased array. In another embodiment, N antenna elements are formed on the spaced apart antenna sections 182, with the N antenna elements comprising at least one active antenna element 152 and up to N−1 passive antenna elements 154 so that the antenna array forms a switched beam antenna.

When an upper conducting segment 154(1) is connected to a respective lower conductive segment 154(2) via an inductive load, the passive antenna element 154 operates in a reflective mode. This results in radio frequency (RF) energy being reflected back from the passive antenna element 154 towards its source, i.e., the active antenna element 152.

When the upper conductive segment 154(1) is connected to a respective lower conductive segment 154(2) via a capacitive load, the passive antenna element 154 operates in a directive mode. This results in RF energy being directed toward the passive antenna element 154 away from the active antenna element 152.

The inductive and capacitive loads are provided by the electrical components 162. An active electrical component 167 may also be connected to the active antenna element 152. Such active devices include amplifiers and a receiver or a transceiver, for example. This segment in general may be populated by any circuit component normally associated with circuit board construction. Although not shown, the antenna array 150 also includes switches for switching between the inductive and capacitive loads, a switch controller, and a driver circuit for providing logic control signals to the switch controller.

While it is desirable cost wise to print as many of the electrical components as possible, certain electrical components may not be practical via this technique. For instance, switches of sufficient speed or low resistance may need to be built in discrete components. These electrical components would be placed and attached to the printed components while the flexible dielectric substrate 140 is still in the two-dimensional state. The connections to the printed components could be done by using the printing process to lay a layer on the electrical pins of the type often found on surface mount integrated circuits with extended metal parallel to the plane of the platform.

When electrical components 163, 167 are mounted on the antenna sections 180 along with one or more antenna elements 154, noise may be generated for interfering with signal reception/transmission. To reduce noise interference, multilayer circuit boards may be used for interconnecting the electrical components 162, 167 with the conductive paths 163 and 165, for example. These multilayer boards provide isolation between the antenna elements 154 and the electrical components 162, 167.

With respect to the folding sections, they alternately may be created by board etching processes. This is a well known circuit board construction process in which non-conductive boards are covered with a conductive material such as copper. The conductive material is than covered by a mask, with the areas to be removed exposed, and the areas to be retained protected. The boards are then exposed to a means to remove the exposed copper. Depending on the specific process this can be via an acid solution or exposure to some other activating agent such as ultraviolet light. Constructions of this type may be formed by multiple layers of such boards fastened together, and the conducting surfaces may be on one or both sides of each layer. The shared boundary interfaces 170 include electrical connections 165 between the folding sections 160 to be moved relative to each other, and are made by flexible materials. This could be done once again by Mylar type materials on which a conductive line has been added by printing technologies. Alternately, a conductive metal could be adhered to the flexible material. In another variation, printing of a conductive material which would be able to withstand creasing could be applied directly across the boundary interfaces between the areas to be moved.

As stated above, the material is then stressed and/or scored to induce mechanical stress lines for folding, and other areas for removal. In the case of scoring, the depth is limited when crossing any electrical component. Alternately, the creasing or scoring would be done before the application of any electrical components that would cross these intentional stress lines. The various two-dimensional areas on either side of the stress lines are then moved relative to each other to produce three-dimensional structures.

Once the proper relationships between the various structures are achieved, there are several methods to force the structures to retain their shape. One approach is that the flexible dielectric substrate 140, or when sandwiched between stiff materials, is subjected to a temperature change that solidifies its structure so that it retains the desired folding.

Another approach is that the three-dimensional structure is mounted in one or more planes to a rigid mounting surface. The mounting may be by glue, solid, mechanical fasteners or any other suitable means to restrain the formed shape from deforming to its original state.

Yet in another approach, the materials are exposed to a chemical which causes the physical structure to stiffen, or an epoxy or similar initially fluid agent is applied to the surface junctions and cured to a hard state. In another approach the entire structure may be placed in a containing mold and filled with liquid that solidifies under appropriate conditions (e.g., temperature, chemical and lighting).

The degree to which the structure is stiffened will be a function of its utilization. In certain applications it will be desired to allow deformation of the various parts of the antenna array structure. This can be done by thermal (e.g., sandwiches of different materials), electrical (e.g., piezoelectric), magnetic (e.g., nano-tube) or mechanical (e.g., micromechanical) means.

Positioning the antenna array structure into its proper shape can be done by specialized mechanical assembly machines. A non-specialized assembly could potentially be done by robots. The assembly process can basically be compared to an origami construction. The generalized use of robots to perform this operation has been demonstrated before, and is well know by those skilled in the art.

These above discussions indicate a situation often found in manufacturing approaches: long time to setup and specific implementations that are the least expensive way to mass produce a large quantity of items, versus a short time to setup and general purpose implementations which are suitable for making small quantities of items. The small quantity approach is often used until a high volume and stable demand exists.

While much of the antenna array structure may be produced by an appropriate folding of the two-dimensional printed elements, it may also be desirable in specific cases to introduce a three-dimensional supporting structure over which the two dimensional electronic printing is formed. The basic reasons for this would be a combination of the following: 1) stiffness to the final construction; 2) spacing of the electrical elements to create capacitive effects; and 3) electromagnetic radiation appropriate spacing relationships (e.g., parasitic ⅛ wavelength separation between the active and parasitic antenna elements 152 and 154).

Antenna elements on both sides of an up and down structure are in general to be avoided, since the currents in opposite directions would cancel each other in pattern generation. If they are on both structures they should be connected in a fashion to assure they appear as one antenna element. This could be done by having their conductive surfaces come into physical contact along their lengths after folding, or through the use of conductive vias. Alternatively, the use of connection traces on both sides of an up and down structure and electrically isolated is beneficial, because in this case you do not want them acting as an antenna element.

Many modifications and other embodiments of the invention will come to the mind of one skilled in the art having the benefit of the teachings presented in the foregoing descriptions and the associated drawings. In addition, other features relating to three-dimensional antenna fabrication are disclosed in the copending patent application filed concurrently herewith and assigned to the assignee of the present invention and is entitled THREE DIMENSIONAL ANTENNA FABRICATION FROM MULTIPLE TWO-DIMENSIONAL STRUCTURES, the entire disclosure of which is incorporated herein in its entirety by reference. Therefore, it is understood that the invention is not to be limited to the specific embodiments disclosed, and that modifications and embodiments are intended to be included within the scope of the appended claims.

That which is claimed is:

1. A method for making an antenna array comprising:

dividing a flexible dielectric substrate into a plurality of folding sections, with each folding section being integrally connected to an adjacent folding section along a shared boundary therebetween, the plurality of folding sections being coplanar with one another when unfolded and including spaced apart antenna sections, spaced apart ground plane sections, and connecting sections therebetween;

forming at least one antenna element on each antenna section, the antenna elements being coplanar with the antenna sections, the ground plane sections and the connecting sections; and folding the plurality of folding sections along the shared boundaries so that the antenna sections extend in a different plane with respect to the ground plane sections.

2. A method according to claim 1 wherein the antenna sections are orthogonal to the ground plane sections after the folding.

3. A method according to claim 1 further comprising forming, before the folding, a ground plane on the spaced apart ground plane sections.

4. A method according to claim 3 further comprising electrically connecting the spaced apart ground planes after the folding.

5. A method according to claim 3 further comprising forming at least one conductive via through at least one of the antenna sections before the folding, so that after the folding the spaced apart ground planes are electrically connected through the at least one conductive via.

6. A method according to claim 1 further comprising attaching a ground plane to the ground plane sections after the folding.

7. A method according to claim 1 further comprising forming, before the folding, mechanical stress lines in the flexible dielectric substrate for defining the shared boundaries.

8. A method according to claim 1 further comprising:

providing at least one electrical component on at least one antenna section before the folding; and forming at least one first conductive path on the antenna section for electrically connecting the at least one electrical component to the at least one antenna element thereon before the folding.

9. A method according to claim 8 further comprising forming at least one second conductive path on the antenna section with the electrical component thereon and on an adjacent folding section, with the at least one second conductive path extending through the shared boundary therebetween.

10. A method according to claim 8 wherein one of the antenna elements comprises an active antenna element having an RF input associated therewith, and another one of the antenna elements comprises a passive antenna element; and wherein the at least one electrical component comprises an impedance element that is selectively connectable to the passive antenna element for antenna beam steering.

11. A method according to claim 10 wherein the at least one electrical component further comprises a switch for selectively connecting the passive antenna element to the impedance element.

12. A method according to claim 8 wherein the at least one electrical component comprises at least one of a receiver and a transmitter so that the at least one antenna element connected thereto comprises an active antenna element.

13. A method according to claim 1 wherein N antenna elements are formed on the spaced apart antenna sections, with the N antenna elements comprising N active antenna elements so that the antenna array forms a phased array.

14. A method according to claim 1 wherein N antenna elements are formed on the spaced apart antenna sections, with the N antenna elements comprising at least one active antenna element and up to N−1 passive antenna elements for forming a switched beam antenna.

15. A method according to claim 1 wherein at least one of the antenna elements comprises upper and lower conductive segments, with the upper conductive segment extending above the ground plane sections in a first direction, and with the lower conductive segments extending below the ground plane sections in a second direction opposite the first direction.

16. A method according to claim 1 further comprising attaching a rigid mounting surface to the flexible dielectric substrate in one or more planes after the folding for holding the flexible dielectric substrate in its folded shape.

17. An antenna array comprising:

a two-dimensional flexible dielectric substrate divided into a plurality of folding sections folded into a three-dimensional structure, each folding section being integrally connected to an adjacent folding section along a shared boundary therebetween, said plurality of folding sections including spaced apart antenna sections, spaced apart ground plane sections and connecting sections therebetween, with the antenna sections being orthogonal to the ground plane sections; and at least one antenna element on each antenna section so that the three-dimensional structure forms the antenna array, the antenna elements being coplanar with the antenna sections.

18. An antenna array according to claim 17 further comprising a ground plane on each spaced apart ground plane section, with the ground plane on each ground plane section being electrically connected together.

19. An antenna array according to claim 17 further comprising at least one conductive via through at least one of the antenna sections so that the spaced apart ground planes are electrically connected through said at least one conductive via.

20. An antenna array according to claim 17 wherein said flexible dielectric substrate comprises mechanical stress lines for defining the shared boundaries.

21. An antenna array according to claim 17 further comprising:

at least one electrical component on at least one antenna section; and at least one first conductive path on the antenna section for electrically connecting said at least one electrical component to said at least one antenna element thereon.

22. An antenna array according to claim 21 further comprising at least one second conductive path on the antenna section with said electrical component thereon and on an adjacent folding section, with said at least one second conductive path extending through the shared boundary therebetween.

23. An antenna array according to claim 21 wherein one of said antenna elements comprises an active antenna element having an RF input associated therewith, and another one of said antenna elements comprises a passive antenna element; and wherein said at least one electrical component comprises an impedance element that is selectively connectable to said passive antenna element for antenna beam steering.

24. An antenna array according to claim 23 wherein said at least one electrical component further comprises a switch for selectively connecting the passive antenna element to said impedance element.

25. An antenna array according to claim 21 wherein the at least one electrical component comprises at least one of a receiver and a transmitter so that the at least one antenna element connected thereto comprises an active antenna element.

26. An antenna array according to claim 17 wherein N antenna elements are on the spaced apart antenna sections, with the N antenna elements comprising N active antenna elements so that the antenna array forms a phased array.

27. An antenna array according to claim 17 wherein N antenna elements are on the spaced apart antenna sections, with the N antenna elements comprising at least one active antenna element and up to N−1 passive antenna elements so that the antenna array forms a switched beam antenna.

28. An antenna array according to claim 17 further comprising a rigid mounting surface coupled to said flexible dielectric substrate in one or more planes for holding said flexible dielectric substrate in its folded shape.

29. An antenna array comprising:

a two-dimensional flexible dielectric substrate divided into a plurality of folding sections folded into a three-dimensional structure, each folding section being integrally connected to an adjacent folding section along a shared boundary therebetween, said plurality of folding sections including spaced apart antenna sections, spaced apart ground plane sections and connecting sections therebetween, with the antenna sections extending in a different direction with respect to the ground plane sections;

at least one antenna element on each antenna section so that the three-dimensional structure forms the antenna array, said antenna elements being coplanar with the antenna sections;

at least one electrical component on at least one of said antenna sections; and at least one first conductive path on said at least one of said antenna sections for electrically connecting said at least one electrical component to said at least one antenna element thereon.

30. An antenna array according to claim 29 further comprising a ground plane on each spaced apart ground plane section, with the ground plane on each ground plane section being electrically connected together.

31. An antenna array according to claim 29 further comprising at least one conductive via through at least one of the antenna sections so that the spaced apart ground planes are electrically connected through said at least one conductive via.

32. An antenna array according to claim 29 wherein said flexible dielectric substrate comprises mechanical stress lines for defining the shared boundaries.

33. An antenna array according to claim 29 further comprising at least one second conductive path on the antenna section with said electrical component thereon and on an adjacent folding section, with said at least one second conductive path extending through the shared boundary therebetween.

34. An antenna array according to claim 29 wherein one of said antenna elements comprises an active antenna element having an RF input associated therewith, and another one of said antenna elements comprises a passive antenna element; and wherein said at least one electrical component comprises an impedance element that is selectively connectable to said passive antenna element for antenna beam steering.

35. An antenna array according to claim 34 wherein said at least one electrical component further comprises a switch for selectively connecting the passive antenna element to said impedance element.

36. An antenna array according to claim 29 wherein the at least one electrical component comprises at least one of a receiver and a transmitter so that the at least one antenna element connected thereto comprises an active antenna element.

37. An antenna array according to claim 29 wherein N antenna elements are on the spaced apart antenna sections, with the N antenna elements comprising N active antenna elements so that the antenna array forms a phased array.

38. An antenna array according to claim 29 wherein N antenna elements are on the spaced apart antenna sections, with the N antenna elements comprising at least one active antenna element and up to N−1 passive antenna elements so that the antenna array forms a switched beam antenna.

39. An antenna array according to claim 29 further comprising a rigid mounting surface coupled to said flexible dielectric substrate in one or more planes for holding said flexible dielectric substrate in its folded shape.

* * * * *

UNITED STATES PATENT AND TRADEMARK OFFICE

CERTIFICATE OF CORRECTION

PATENT NO. : 7,602,348 B2
APPLICATION NO. : 11/344283
DATED : October 13, 2009
INVENTOR(S) : Steven J. Goldberg It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 811 days.

Signed and Sealed this

Fifth Day of October, 2010

David J. Kappos

David J. Kappos
*Director of the United States Patent and Trademark Office*